US006905605B2

(12) United States Patent
Klomp

(10) Patent No.: US 6,905,605 B2
(45) Date of Patent: Jun. 14, 2005

(54) METHOD FOR INHIBITING THE PLUGGING OF CONDUITS BY GAS HYDRATES

(75) Inventor: Ulfert Cornelis Klomp, Amsterdam (NL)

(73) Assignee: Shell Oil Company, Houston, TX (US)

( * ) Notice: Subject to any disclaimer, the term of this patent is extended or adjusted under 35 U.S.C. 154(b) by 227 days.

(21) Appl. No.: 10/240,816

(22) PCT Filed: Apr. 6, 2001

(86) PCT No.: PCT/EP01/04075

§ 371 (c)(1),
(2), (4) Date: Oct. 4, 2002

(87) PCT Pub. No.: WO01/77270

PCT Pub. Date: Oct. 18, 2001

(65) Prior Publication Data

US 2003/0057158 A1 Mar. 27, 2003

(51) Int. Cl.[7] ..... E21B 37/06; C09K 7/06

(52) U.S. Cl. ..... 210/698; 507/90; 507/103; 507/130; 507/242; 507/260; 137/13; 166/310; 95/153; 585/15

(58) Field of Search ..... 210/698; 507/90, 507/103, 130, 242, 260; 137/13; 166/310; 585/15; 95/153

(56) References Cited

U.S. PATENT DOCUMENTS 3,244,188 A * 4/1966 Parks et al. ..... 137/15.05
3,578,421 A * 5/1971 Andress et al. ..... 44/331
3,965,027 A * 6/1976 Boffardi et al. ..... 252/180
4,018,702 A * 4/1977 Boffardi et al. ..... 252/389.52
5,648,575 A 7/1997 Klomp et al.
5,879,561 A 3/1999 Klomp et al.
5,900,516 A 5/1999 Talley et al.
5,998,565 A 12/1999 deBrabander-van den Berg et al.
6,369,004 B1 * 4/2002 Klug et al. ..... 507/90
6,544,932 B2 * 4/2003 Klug et al. ..... 507/90

FOREIGN PATENT DOCUMENTS

| | | |
|---|---|---|
| EP | 0 736 130 B1 | 7/1998 |
| EP | 0 824 631 B1 | 7/1999 |
| NL | 9200043 | 1/1992 |
| WO | 88 01180 | 2/1988 |
| WO | 93 14147 | 7/1993 |
| WO | 93 25798 | 12/1993 |
| WO | 97 19987 | 6/1997 |
| WO | 98 05745 | 2/1998 |
| WO | 99 13197 | 3/1999 |
| WO | 99 16810 | 4/1999 |
| WO | 00 56804 | 9/2000 |
| WO | 00 58388 | 10/2000 |

* cited by examiner

*Primary Examiner*—Minh-Chau T. Pham
(74) *Attorney, Agent, or Firm*—William E. Hickman

(57) ABSTRACT

A method for inhibiting hydrate formation in a hydrocarbon flow by adding an amount of a dendrimeric compound effective to inhibit formation of hydrates at conduit temperatures and pressures, and flowing the mixture containing the dendrimeric compound and any hydrates through the conduit. Preferably, a hyperbranched polyester amide is used as hydrate formation inhibitor compound.

13 Claims, No Drawings

METHOD FOR INHIBITING THE PLUGGING OF CONDUITS BY GAS HYDRATES

FIELD OF THE INVENTION

The present invention relates to a method for inhibiting the plugging by gas hydrates of conduits containing a mixture of low-boiling hydrocarbons and water.

BACKGROUND OF THE INVENTION

Low-boiling hydrocarbons, such as methane, ethane, propane, butane and iso-butane, are normally present in conduits which are used for the transport and processing of natural gas and crude oil. When varying amounts of water are also present in such conduits the water/hydrocarbon mixture is, under conditions of low temperature and elevated pressure, capable to form gas hydrate crystals. Gas hydrates are clathrates (inclusion compounds) in which small hydrocarbon molecules are trapped in a lattice consisting of water molecules. As the maximum temperature at which gas hydrates can be formed strongly depends on the pressure of the system, hydrates are markedly different from ice.

The structure of the gas hydrates depends on the type of the gas forming the structure:methane and ethane form cubic lattices having a lattice constant of 1.2 nm (normally referred to as structure I) whereas propane and butane form cubic lattices having a lattice constant of 1.73 nm (normally referred to as structure II). It is known that even the presence of a small amount of propane in a mixture of low-boiling hydrocarbons will result in the formation of type II gas hydrates which type is therefore normally encountered during the production of oil and gas. It is also known that compounds like methyl cyclopentane, benzene and toluene are susceptible of forming hydrate crystals under appropriate conditions, for example in the presence of methane. Such hydrates are referred to as having structure H.

Gas hydrate crystals which grow inside a conduit such as a pipeline are known to be able to block or even damage the conduit. In order to cope with this undesired phenomenon, a number of remedies has been proposed in the past such as removal of free water, maintaining elevated temperatures and/or reduced pressures or the addition of chemicals such as melting point depressants (antifreezes). Melting point depressants, typical examples of which are methanol and various glycols, often have to be added in substantial amounts, typically in the order of several tens of percent by weight of the water present, in order to be effective. This is disadvantageous with respect to costs of the materials, their storage facilities and their recovery which is rather expensive.

Another approach to keep the fluids in the conduits flowing is taken by adding crystal growth inhibitors and/or compounds which are in principle capable of preventing agglomeration of hydrate crystals. Compared to the amounts of antifreeze required, already small amounts of such compounds are normally effective in preventing the blockage of a conduit by hydrates. The principles of interfering with crystal growth and/or agglomeration are known.

Several classes of compounds have been proposed as potential crystal growth inhibitors. For instance, cold-water fish peptides and glycopeptides appear to be effective in interfering with the growth of gas-hydrate crystals but their production and use for this purpose are rather uneconomical. The use of polymers having a linear backbone such as the (co-)polymers N-vinyl-2-pyrrolidone for inhibiting the formation, growth and/or agglomeration of gas hydrates has been described in International Patent Application Publication WO93/25798. The use of compounds normally referred to as "quats" has been described in, inter alia, EP-A-736130, EP-A-824631, U.S. Pat. No. 5,648,575 and WO 98/05745. The "quat" type compounds focus around quaternary onium, in particular quaternary ammonium, compounds containing two or three lower alkyl chains, preferably containing C4 and/or C5 alkyl groups and one or two longer alkyl chains, preferably containing at least eight carbon atoms, which are bound to the central nitrogen moiety, thus forming a cationic species which is matched by a suitable anion such as a halide or other inorganic anion. Preferred "quats" comprise two long chains, comprising between 8 and 50 carbon atoms, which may also contain ester groups and/or branched structures.

It has now been found that a completely different class of compounds can also be used in the combat against hydrate blockage of conduits thus substantially widening the window of application in this area.

SUMMARY OF THE INVENTION

The present invention therefore relates to a method for inhibiting the plugging of a conduit containing a flowable mixture comprising at least an amount of hydrocarbons capable of forming hydrates in the presence of water and an amount of water, which method comprises adding to the mixture an amount of a dendrimeric compound effective to inhibit formation and/or accumulation of hydrates in the mixture at conduit temperatures and pressures; and flowing the mixture containing the dendrimeric compound and any hydrates through the conduit.

DETAILED DESCRIPTION OF THE INVENTION

Dendrimeric compounds are in essence three-dimensional, highly branched oligomeric or polymeric molecules comprising a core, a number of branching generations and an external surface composed of end groups. A branching generation is composed of structural units which are bound radially to the core or to the structural units of a previous generation and which extend outwards. The structural Units have at least two reactive monofunctional groups and/or at least one monofunctional group and one multifunctional group. The term multifunctional is understood as having a functionality of about 2 or higher. To each functionality a new structural unit may be linked, a higher branching generation being produced as a result. The structural units can be the same for each successive generation but they can also be different. The degree of branching of a particular generation present in a dendrimeric compound is defined as the ratio between the number of branchings present and the maximum number of branchings possible in a completely branched dendrimer of the same generation. The term functional end groups of a dendrimeric compound refers to those reactive groups which form part of the external surface. Branchings may occur with greater or lesser regularity and the branchings at the surface may belong to different generations depending on the level of control exercised during synthesis. Dendrimeric compounds may have defects in the branching structure, may also be branched asymmetrically or have an incomplete degree of branching in which case the dendrimeric compound is said to contain both functional groups and functional end groups.

Dendrimeric compounds as referred to hereinabove have been described in, inter alia, International Patent Application Publications WO 93/14147 and WO 97/19987 and in Dutch Patent Application 9200043. Dendrimeric compounds have also been referred to as "starbust conjugates", for instance in International Patent Application Publication WO 88/01180. Such compounds are described as being polymers characterized by regular dendrimeric (tree-like) branching with radial symmetry.

Functionalized dendrimeric compounds are characterized in that one or more of the reactive functional groups present in the dendrimeric compounds have been allowed to react with active moieties different from those featuring in the structural units of the starting dendrimeric compounds. These moieties can be selectively chosen such that, with regard to its ability to prevent the growth or agglomeration of hydrate crystals, the functionalized dendrimeric compound out performs the dendrimeric compound.

The hydroxyl group is one example of a functional group and functional end group of a dendrimeric compound. Dendrimeric compounds containing hydroxyl groups can be functionalized through well-known chemical reactions such as esterification, etherification, alkylation, condensation and the like. Functionalized dendrimeric compounds also include compounds which have been modified by related but not identical constituents of the structural units such as different amines which as such may also contain hydroxyl groups.

A preferred class of dendrimeric compounds giving rise to growth inhibition of gas hydrate crystals comprises the so-called hyperbranched polyesteramides, commercially referred to as HYBRANES (the word HYBRANE is a trademark). The preparation of such compounds has been described in more detail in International Patent Application Nos. WO-A-99/16810, WO-A-00/58388 and WO-A-00/56804. Accordingly, the dendrimeric compound is preferably a condensation polymer containing ester groups and at least one amide group in the backbone, having at least one hydroxyalkylamide end group and having a number average molecular weight of at least about 500 g/mol. This class of polymers has a lower degree of branching than the poly (propylene imine) dendrimers described in WO-A-93/14147, but still retains the non-linear shape and the high number of reactive end groups which are characteristic of dendrimeric compounds. Compounds belonging to this class of dendrimers are suitably produced by reacting a cyclic anhydride with an alkanolamine giving rise to dendrimeric compounds by allowing them to undergo a number of (self-)condensation reactions leading to a predetermined level of branching. It is also possible to use more than one cyclic anhydride and/or more than one alkanolamine.

The alkanolamine may be a dialkanolamine, a trialkanolamine or a mixture thereof.

Examples of suitable dialkanolamines are 3-amino-1,2-propanediol, 2-amino-1,3-propanediol, diethanolamine bis (2-hydroxy-1-butyl)amine, dicyclohexanolamine and diisopropanolamine. Diisopropanolamine is particularly preferred.

As an example of a suitable trialkanolamine reference is made to tris(hydroxymethyl)aminomethane or triethanolamine.

Suitable cyclic anihydrides comprise succinic anhydride, glutaric anhydride, tetrahydrophthalic anhydride, hexahydrophthalic anhydride, phthalic anhydride, norbornene-2,3-dicarboxylic anhydride, naphthalenic dicarboxylic anhydride. The cyclic anhydrides may contain substituents, in particular hydrocarbon (alkyl or alkenyl) substituents. The substituents suitably comprise from 1 to 15 carbon atoms. Suitable examples include 4-mthylphthalic anhydride, 4-methyltetrahydro- or 4-methylhexahydrophthalic anhydride, methyl succinic anhydride, poly(isobutyl) succinic anhydride and 2-dodecenyl succinic anhydride. Mixtures of anhydrides can also be used. The (self-) condensation reaction is suitably carried out without a catalyst at temperatures between about 100 to about 200° C. By carrying out such (self-) condensation reactions compounds will be obtained having amide-type nitrogen moieties as branching points and with hydroxyl end groups in the base polymer. Depending on the reaction conditions, predetermined molecular weight ranges and number of end groups can be set. For instance, using hexahydrophthalic anhydride and diisopropanolamine polymers can be produced having a number average molecular weight tuned between about 500 to about 50,000, preferably between about 670 to about 10,000, more preferably between about 670 to about 5000. The number of hydroxyl groups per molecule in such case is suitably in the range between about 0 to about 13.

The functional end groups (hydroxyl groups) of the polycondensation products can be modified by further reactions as disclosed in the above-mentioned applications WO-A-00/58388 and WO-A-00/56804. Suitable modification can take place by reaction of at least part of the hydroxyl end groups with fatty acids, such as lauric acid or coco fatty acid. Another type of modification can be obtained by partial replacement of the alkanolamine by other amines, such as secondary amines, e.g., N,N-bis-(3-dimethylaminopropyl) amine, morpholine or non-substituted or alkyl-substituted piperazine, in particular N-methyl piperazine. The use of N,N-bis-(dialkylaminoalkyl)amines results in dendrimeric polymers that have been modified to have tertiary amine end groups. In particular the products prepared by the polycondensation of 2-dodecenyl succinic anhydride or hexahydrophthalic anhydride with diisopropanolamine that have been modified by morpholine, tertiary amine or non-substituted or alkyl-substituted piperazine end groups are very suitable for use in the process of the present invention.

Examples of commercially available HYBRANES are S1200 and HA1300.

HYBRANE S1200 is a dendrimeric compound based on structural units composed of succinic anhydride and di-isopropanolamine having a number average molecular weight of 1200. It has been found that this compound shows activity in inhibiting the growth of THF hydrate crystals.

HYBRANE HA1300 is a functionalised dendrimeric compound based on structural units composed of hexahydrophthalic anhydride and di-isopropanolamine and N,N-bis-(3-dimethylaminopropyl)amine, having a number average molecular weight of 1300. The use of these units results in a product in which the end groups are functionalised in the form of a tertiary amine group. This compound has shown a remarkable effect in inhibiting the growth of THF hydrate crystals. It has also been found that this compound can be used advantageously as hydrate growth inhibitor in systems containing pressurised gas, condensate and water.

The amount of the dendrimeric and functionalised dendrimeric compounds which can be used in the process according to the present invention is suitably in the range between 0.05 and 10% wt, preferably between 0.1 and 5% wt and most preferably between 0.5 and 3.5% wt, based on the amount of water in the hydrocarbon-containing mixture.

The dendrimeric and functionalised dendrimeric compounds can be added to the subject mixture of low-boiling hydrocarbons and water as their dry powder, or, preferably, in concentrated solution. They can also be used in the presence of other hydrate crystal growth inhibitors, for instance those described in the patent specifications referred to hereinbefore.

It is also possible to add other oil-field chemicals such as corrosion and scale inhibitors to the mixture containing the dendrimeric and/or functionalised dendrimeric compounds. Suitable corrosion inhibitors comprise primary, secondary or tertiary amines or quaternary ammonium salts, preferably amines or salts containing at least one hydrophobic group. Examples of corrosion inhibitors comprise benzalkonium halides, preferably benzyl hexyldimethyl ammonium chloride.

The invention will now be elucidated by means of the following, non-limiting Examples. The experiments have been carried out by using equipment as described in FIG. 1A of EP-A-736130 comprising a glass vessel placed in a thermostatically controlled bath, provided with the solution to be tested, a capillary tube protruding vertically into the solution in the bath and capable of keeping a seed crystal (ice) in contact with the solution.

EXAMPLE I

Growth Inhibition of Large THF Hydrate Crystals

Experiment 1 (Blank)

A standard solution was prepared containing 78.7% wt water, 18.4% wt tetrahydrofuran (THF) and 2.9% wt sodium chloride. At atmospheric pressure, this solution is known to form hydrate (structure II) crystals at a temperature of 0° C.

During three duplicate experiments, 70 grams of this solution was transferred into a glass vessel which was immersed (up to the liquid level in the vessel) in the bath which was kept at a temperature of 0° C. After 30 minutes, by which time the temperature of the solution had reached also 0° C., hydrate formation was initiated through the insertion of an ice crystal seed (about 0.1 gram) using the capillary tube. The system was left for three hours during which hydrate crystals were formed and after which the hydrate crystals were weighed. The amounts of hydrate formed during these three blank experiments were 8.6, 8.2 and 9.2 grams, respectively.

Experiment 2 (Use of a Dendrimeric Growth Inhibitor)

A standard solution was prepared containing 78.3% wt water, 18,3% wt THF, 2.9% wt sodium chloride and 0.5% wt of the dendrimeric compound HYBRANE S1200 (commercially obtainable from DSM, Geleen, the Netherlands). Experiment 1 was repeated. The amount of hydrates formed amounted to 5.1 gram. When the amount of the growth inhibitor was doubled (in a solution containing 78.0% wt water, 18.1% wt THF an 2.9% wt sodium chloride) 3.3 grams of hydrate were formed.

During duplicate experiments 4.4 grams of hydrates were formed from the solution containing 0.5% wt of HYBRANE S1200 and 4.1 grams from the solution containing 1.0% wt of HYBRANE S1200.

These experiments indicate that hydrate growth is markedly slowed down by using HYBRANE S1200 in the solution.

Experiment 3 (Use of a Functionalised Dendrimeric Growth Inhibitor)

A standard solution was prepared containing 78.3% wt water, 18,3% wt THF, 2.9% wt sodium chloride and 0.5% wt of the functionalised dendrimeric compound HYBRANE HA1300 (commercially obtainable from DSM, Geleen, the Netherlands). Experiment 1 was repeated. The amount of hydrates formed amounted to 2.3 grams. When the amount of the growth inhibitor was doubled (in a solution containing 78.0% wt water, 18.1% wt THF and 2.9% wt sodium chloride) less than 0.1 gram of hydrate could be found. These experiments clearly indicate that hydrate growth is effectively slowed down by using HYBRANE HA1300 in the solution.

Experiment 4 (Additional Hydrate Formation in the Solutions Containing Dendrimeric Growth Inhibitors)

Some pieces of the hydrates formed in solutions used in experiment 1 were immersed in the solutions used in experiments 2 and 3. Subsequently all solutions (including the "blank" solutions used in experiment 1) were heavily agitated by using a spatula. Many small hydrate crystals were formed immediately in the "blank" solutions. Less crystals were formed in the solutions containing respectively 0.5% wt HYBRANE S1200, 1.0% wt HYBRANE S1200 and 0.5% wt HYBRANE HA1300 and no additional crystals were formed in the solution containing 1.0% wt HYBRANE HA1300.

After keeping the vessels for one hour at 0° C. most of the "blank" solutions and some of the solutions containing either 0.5% wt of HYBRANE S1200, 1.0% wt of HYBRANE S1200 or 0.5% wt HYBRANE HA1300 inhibitor had been converted into hydrates but only a negligible amount of additional hydrates had been formed in the solution containing 1.0% wt of HYBRANE HA1300.

EXAMPLE II

Hydrate Inhibition in a Mixture Containing Gas, Condensate and Water at Elevated Pressure Experiment 1 (Blank)

An autoclave having a fixed volume of 308 ml was filled with 80.8 grams of stabilised condensate obtained from the Maui field, 40 grams of water and 12.7 grams of propane. Then methane gas was introduced into the autoclave such that the equilibrium pressure in the autoclave was 4.07 MPa at a temperature of 22° C. Thereafter the content in the autoclave was rapidly cooled by means of a blade stirrer to 5.8° C. During cooling the pressure in the system lowered from 4.07 MPa at 22° C. to 3.63 MPa at 5.8° C. Clear signs of hydrate formation (a sharp drop of the system pressure accompanied by a temporary increase in temperature) were seen 36 minutes after the cooling cycle was started. Hereafter the temperature was raised to 23° C. and the autoclave was kept at this temperature for one hour. Thereafter the autoclave was cooled rapidly to the same temperature as reached in the first cooling cycle. At this temperature the pressure in the autoclave amounted to 3.62 MPa. Clear signs of hydrate formation were observed after 30 minutes. The cycle of raising and lowering the temperature was repeated once more. Hydrate formation was observed after 31 minutes. A final cycle indicated crystal formation after 35 minutes. It can be calculated that at a pressure of 3.63 MPa hydrates can be formed in the autoclave below a temperature of 15.3° C. indicating that the induction time for hydrate formation in the "blank" system is approximately 34 minutes at a subcooling of 9.5° C.

Experiment 2 (Use of 1.0% wt of a Dendrimeric Compound)

In this experiment the autoclave was filled with 80.8 grams of stabilised Maui condensate, 39.7 grams of water, 13.4 grams of propane and 0.4 grams of HYBRANE S1200. Then, methane gas was added such that the equilibrium pressure in the autoclave was 4.0–0.9 MPa at a temperature of 21.6° C. Thereafter the content of the autoclave was rapidly cooled using a blade stirrer to a temperature of 5.8° C. During cooling the pressure in the autoclave dropped to 3.60 MPa. Clear signs of hydrate formation (a sharp drop of the system pressure accompanied by a temporary increase in temperature) were seen 6.2 hours after the cooling cycle was started. It can be calculated that at a pressure of 3.60 MPa hydrates can be formed at a temperature below 15.2° C. which is 9.4° C. above the actual temperature of the gas/water/condensate mixture during the experiment, indicating that at a subcooling of 9.4° C. the induction time for hydrate formation has been increased from approximately 34 minutes to 6.2 hours due to the addition of 1.0% wt of HYBRANE S1200 to the mixture.

Experiment 3 (Use of 1% wt of a Functionalised Dendrimeric Compound)

In this experiment the autoclave was filled with 80.8 grams of stabilised Maui condensate, 40 grams water, 13.2 grams propane and 0.41 grams of HYBRANE HA1300. Methane gas was added to the autoclave in such a way that the equilibrium pressure was 4.07 MPa at a temperature of 22° C. Like in experiment 1 the content in the autoclave was cooled rapidly with a blade stirrer to 5.8° C. The pressure dropped to 3.62 MPa. No signs of hydrate formation were observed when the system was kept at this temperature for 26 hours. Neither temperature nor pressure had changed indicating that no gas had been consumed due to hydrate formation. It can be calculated that hydrates can be formed under these conditions below 15.4° C. These results show that in the presence of this growth inhibitor the induction time for hydrate formation in this system increased from approximately 34 minutes to more than 26 hours at a subcooling of 9.6° C.

The cooling and stirring was stopped during the next two days during which the autoclave reached ambient temperature. Subsequently the rapid cooling cycle was applied to the same temperature and pressure as reached before. No signs of gas consumption due to hydrate formation were observed and the autoclave was kept at this temperature for 24 hours. Hereinafter, the content of the autoclave was rapidly cooled to 0.5° C. The pressure dropped from 3.62 MPa to 3.47 MPa. No signs of gas consumption due to hydrate formation were observed when the autoclave was kept at this temperature for 24 hours. It can be calculated that hydrates can be formed under these conditions at a temperature of 15.1° C. which is 14.6° C. above the actual temperature of the gas/water/condensate mixture during the experiment. Under these conditions the induction time for hydrate formation is more than 24 hours at a subcooling of 14.6° C.

Whilst keeping the temperature of the content of the autoclave at 0.5° C., more methane was added such that the equilibrium pressure in the autoclave increased to 4.07 MPa. No signs of gas consumption due to hydrate formation were observed when the system was kept for 24 hours at a pressure of 4.07 MPa and at a temperature of 0.5° C. It can be calculated that at a pressure of 4.07 MPa hydrates can form below a temperature of 16.2° C. which is 15.7° C. above the actual temperature of the gas/water/condensate mixture during the experiment. Under these conditions the induction time for hydrate formation is more than 24 hours at a subcooling of 15.7° C.

Hereafter the stirring was discontinued and the gas/water/condensate mixture was kept stagnant at a temperature of 0.5° C. With in 1 hour the pressure rose from 4.07 MPa to 4.12 MPa (which may have been caused by less efficient cooling of the top part of the autoclave under stagnant conditions). This situation remained unchanged for 20 hours whereafter stirring was resumed. When the stirring started the pressure dropped rapidly to 4.07 MPa, indicating that no additional hydrates had formed during the stagnant period of 20 hours at a subcooling of 15.7° C.

Experiment 4 (Use of 0.5% wt of a Functionalised Dendrimeric Compound)

In this experiment the autoclave was filled with 80.8 grams of stabilised Maui condensate, 39.8 grams of water, 13.2 grams of propane and 0.2 grams of HYBRANE HA1300. Then, methane gas was added such that the equilibrium pressure in the autoclave was 4.11 MPa at a temperature of 21.8° C. Thereafter the content of the autoclave was rapidly cooled using a blade stirrer to a temperature of 0.4° C. During cooling the pressure in the autoclave dropped to 3.51 MPa. No signs of gas consumption due to hydrate formation were observed when the system was kept 64 hours at a temperature of 0.4° C. It can be calculated that at a pressure of 3.51 MPa hydrates can be formed at a temperature below 15.2° C. which is 14.8° C. above the actual temperature of the gas/water/condensate mixture during the experiment, indicating that the induction time for hydrate formation in this system is more than 64 hours at a subcooling of 14.8° C.

Hereafter, the autoclave was cooled to a temperature of 0.0° C. and additional methane gas was introduced such that the pressure in the autoclave at this temperature was 4.07 MPa. No signs of gas consumption due to hydrate formation were observed when the system was kept for 24 hours at a pressure of 4.07 MPa and at a temperature of 0.0° C. It can be calculated that at a pressure of 4.07 MPa hydrates can be formed at a temperature below 16.1° C. which is 16.1° C. above the actual temperature of the gas/water/condensate mixture during the experiment, indicating that the induction time for hydrate formation in this system is more than 24 hours at a subcooling of 16.1° C.

Hereafter the stirrer was stopped and the gas/water/condensate mixture was kept stagnant at a temperature of 0.0° C. Within 1 hour the pressure rose from 4.07 to 4.12 MPa (similar to what was experienced in experiment 2). The pressure remained steady for the next 23,25 hours whereafter stirring was resumed. The pressure decreased rapidly to 4.03 MPa indicating that at most tiny amounts hydrates could have been formed during the stagnant period. However, when the mixture was stirred for the next 4 hours at a temperature of 0.0° C. the pressure remained steady at 4.03 MPa indicating that no additional hydrates were formed during this period This result indicates that when 0.5% wt of this growth inhibitor is present in the water phase at most a tiny (but possibly no) amount of hydrates had formed in the gas/water/condensate mixture during a stagnant period of 24 hours at a subcooling of 16.1° C.

Experiment 5 (Use of 0.25% wt of a Functionalised Dendrimeric Compound)

In this experiment the autoclave was filled with 80.9 grams of stabilised Maui condensate, 40.0 grams of water, 13.2 grams of propane and 0.1 grams of HYBRANE HA1300. Then methane gas was added such that the equilibrium pressure in the autoclave amounted to 4.10 MPa at a temperature of 22° C. Thereafter the content of the autoclave was rapidly cooled using a blade stirrer to a temperature of 0.1° C. During cooling the pressure in the autoclave dropped to 3.50 MPa whilst the temperature remained at 0.1° C. No signs of gas consumption due to hydrate formation were observed when the system was kept for 23.5 hours at this temperature. It can be calculated that at a pressure of 3.50 MPa hydrates can be formed at a temperature below 15.1° C. which is 15.0° C. above the actual temperature of the gas/water/condensate mixture during the experiment, indicating that the induction time for hydrate formation in this system is more than 23.5 hours at a subcooling of 15.0° C.

Hereafter additional methane was introduced into the autoclave and the temperature of the content of the autoclave was slightly lowered such that the pressure in the autoclave was 4.07 MPa at 0.0° C. No signs of gas consumption due to hydrate formation were observed when the system was kept for 24 hours at a pressure of 4.07 MPa and at temperature of 0.0° C. It can be calculated that at a pressure of 40.7 hydrates can be formed at a temperature below 16.1° C. which is 16.1° C. above the actual temperature of the gas/water/condensate mixture during the experiment, indicating that the induction time for hydrate formation in this system is more than 24 hours at a subcooling of 16.1° C.

EXAMPLE III

Hydrate Inhibition in a Mixture Containing Gas, Condensate and Water at Elevated Pressure Under Conditions of Turbulent Flow Experiment 1 (Blank)

This experiment was carried out by using a 108 m long model pipeline having an internal diameter of 19 mm (¾"). This model pipeline is divided in 9 consecutive sections (hereafter referred to as "pins"), each having a total length of 12 m and consisting of two 180° circular bends and two straight pipe sections. These straight sections are jacketed by a concentric pipe through which a cooling and/or heating liquid can be circulated in a direction opposite to the flow direction of the hydrate forming medium in the pipe. The numbering of the pins is defined such that the hydrate forming medium enters the pipe at the inlet of pin 1 and exits the pipe at the outlet of pin 9. Nine differential pressure meters are installed to simultaneously measure the pressure drop over each pin and a tenth differential pressure meter is used to measure the total pressure drop between the inlet of pin 1 and the outlet of pin 9. Thermocouples are installed at the outlet of every pin and also at the inlet of pin 1, to monitor the temperature of the hydrate forming medium in the pipe.

A small separator is installed between the inlet and the outlet of the loop. Both the pressure and the temperature in the separator are also continuously monitored. A gear pump is used to pump a liquid mixture of water and gas-saturated condensate or crude oil from the separator, via a Coriolis meter (which is used to the density and flow velocity of the liquids) to the inlet of pin 1. Liquids exiting the loop through pin 9 are returned to the separator vessel. Viewing windows are installed immediately downstream of the outlets of pin 6 and 8 to allow (if the hydrate forming medium is sufficiently transparent) visual observation of hydrate formation in the loop. The total volume of the loop facility is approximately 62 liters.

In this experiment the loop facility was filled with consecutively 4 liters of de-mineralised water, 39.2 liters (29.8 kilograms) of stabilised condensate and 3.22 kilograms of propane. Subsequently methane gas was added such that the equilibrium pressure in the loop facility was approximately 7.0 MPa at a temperature of 23° C. It can be calculated that stable hydrates can form in this system at temperatures lower than 16° C.

After the gas/condensate/water mixture had been circulated and homogenised at a constant flow velocity of approximately 0.5 m/s and at a temperature of 23° C. the experiment was started by starting a cooling cycle during which the temperature of the hydrate forming medium was controlled such that the medium entered the loop at a constant flow velocity of 0.5 m/s and at a constant temperature of 23° C. but was exponentially cooled mainly in pins 1–3 to attain in pins 4–8 a minimum temperature Tmin which was (starting from an initial temperature of 23° C.) gradually lowered by 1° C. per hour. The medium was reheated in pin 9 to a temperature of 23° C. before being returned to the inlet of the loop.

Because of the formation of immobile hydrate deposits, the pressure drop between the inlet and the outlet of the loop started to increase rapidly once Tmin had reached a value of 15° C. This increase lasted for approximately 15 minutes after which period the loop was considered to be blocked by hydrates (the loop is considered to be blocked if the pressure drop over the loop exceeds 2000 Pa/m).

Experiment 2 (Use of 0.50% wt of a Functionalised Dendrimeric Compound)

In this experiment one liter of water, in which 25 grams of HYBRANE HA1300 were dissolved, had been added to the gas/condensate/water mixture which was used in experiment 1. The mixture was homogenised through circulation at a constant flow velocity of 0.5 m/s an at a constant temperature of 23° C. Hereafter the temperature of the circulating hydrate forming medium at any location in the test facility was rapidly (within one hour) cooled to a constant temperature of 8.5° C. No heating was applied in pin 9 during this experiment. Hereafter the circulation was maintained at a constant temperature of 8.5° C. during 23 hours. During this period the pressure drop between the inlet and the outlet of the loop increased slightly from 160 Pa/m to approximately 200 Pa/m. Subsequently the circulation was stopped and the medium was left stagnant in the loop at a constant temperature of 8.5° C. during the next 19.2 hours. Hereafter the circulation was resumed during 1.5 hours whilst the temperature of the medium was kept constant at 8.5° C. During this period the pressure drop over the loop remained constant and virtually equal to the pressure drop over the loop which was measured just before the stagnant period, indicating that no additional hydrates had formed during the stagnant period. This experiment indicates that, by using 0.5% wt (based on the amount of water present) of HYBRANE HA1300 no, or at most very small amounts, of immobile hydrates had been formed in the hydrate forming medium during 23 hours of turbulent flow and a consecutive 19 hour period under stagnant conditions at 7.5 degrees of subcooling whereas in experiment 1 the loop became already blocked by hydrates after one hour of circulation at 1° C. of subcooling.

EXAMPLE IV

Hydrate Inhibition by Functionalised HYBRANES During "Rolling Ball" Experiments The ability of several functionalised HYBRANES to prevent hydrate formation was tested by using a "rolling ball apparatus". The rolling ball apparatus contains four cylindrical and transparent high pressure cells. Each cell also contains a stainless steel ball which can freely roll forth and back over the entire length of the cell when the cell is tilted. Each cell is also equipped with a manometer to allow a reading of the gas pressure in the cell and some auxiliary tubing to facilitate cleaning and filling of the cell. The total volume of the cell (including auxiliary tubing) is approximately 53 ml. After being filled at ambient temperature with water and pressurised gas and/or a HYBRANE and/or condensate or oil, the four cells are mounted horizontally in a rack. Subsequently the rack and cells are placed (in horizontal position) in a mixture of ice and water which is contained in a thermally insulated container such that the temperature of the cells can be kept equal to 0° C. during at least a few days. The entire assembly (cells plus rack plus insulated container) is mounted on an electrically powered seesaw which, when activated, causes the stainless steel balls to roll forth and back over the entire length of the cells once every eight seconds.

Stagnant pipeline shut-in conditions are simulated by leaving the cells stationary (in horizontal position) during a pre-determined period. Flowing pipeline conditions are simulated by switching on the seesaw such that the balls continuously agitate the liquid contents of the cells.

The ability of some functionalised HYBRANES to prevent hydrate formation (kinetic inhibition effect) under flowing conditions was tested during the following rolling ball experiments.

Experiment 1 (Blank Experiment Conducted at 9° C. of Subcooling)

At ambient temperature (approximately 20° C.) two cells were filled with respectively 3 ml of de-mineralised water and 9 ml of a mixture containing equal parts (by volume) of Maui condensate and toluene. Hereafter the cells were pressurised with a synthetic natural gas having the following composition: methane 86.2 mol %, ethane 2.8 mol %, propane 5.8 mol %, n-butane 0.8 mol %, iso-butane 0.6 mol %, nitrogen 1.7 mol % and carbon dioxide 2.1 mol %. The water/condensate/toluene/gas mixture was carefully equilibrated such that at ambient temperature the pressure in the cells was 3.0 MPa. Hereafter the cells were mounted on the rack and subsequently immersed in the ice/water mixture. The seesaw was activated such that the stainless steel balls rolled back and forth over the entire length of the cells once every eight seconds. Soon after the cells were immersed in the water/ice mixture the pressure in the cells dropped to 2.7 MPa because of the cooling of the mixture to 0° C. At a pressure of 2.7 MPa, stable hydrates can form in the cell at temperatures below 9° C. which means that the experiment was conducted at 9 degrees of subcooling. It was observed that in both cells a solid layer of hydrates, which also prevented the balls from moving, had formed within one hour after activation of the seesaw.

Experiment 2 (HYBRANES Preventing Hydrate Formation at 9° C. of Subcooling)

The ability of several functionalised HYBRANES to prevent hydrate formation at 9° C. of subcooling was tested in duplicate by filling two cells with the same water/condensate/toluene/gas mixture as was used in experiment 1 described above, except for the addition of 0.03 grams of a functionalised HYBRANE to the contents of both cells. Similar to experiment 1, the cells were immersed in an ice/water bath after which the seesaw was immediately activated.

It was observed that no hydrates formed within 20 hours after immersion of two cells in the ice bath and activation of the seesaw if the two cells contained 0.03 grams of either of the following functionalised HYBRANES:

HA1550, HA1690 and HA5890: the structural units in which are hexahydrophthalic anhydride, di-isopropanol amine and N,N-bis-(3-dimethylaminopropyl)amine, having a number-average molecular weight (Mn) of 1500, 1600 and 5800, respectively;

HAm 1290 and HAm 2490: the structural units of which are hexahydrophthalic anhydride, di-isopropanol amine and morpholine having a Mn of 1200 and 2400, receptively;

HAm 67.5V1625: the structural units in which are hexahydrophthalic anhydride, di-isopropanol amine, morpholine and coco fatty acid having a Mn of 1600;

H/D Am 90 1300: the structural units in which are hexahydrophthalic anhydride, di-isopropanol amine, morpholine and 2-dodecenyl succinic anhydride, having a Mn of 1300;

HAp 1390: the structural units in which are hexahydrophthalic anhydride, di-isopropanol amine and N-methyl piperazine with a Mn of 1300.

Experiment 3 (Blank Experiment Conducted at 11° C. of Subcooling)

At ambient temperature (approximately 20° C.) two cells were filled with respectively 3 ml of demineralised water and 9 ml of a mixture containing equal parts (by volume) of Maui condensate and toluene. Hereafter the cells were pressurised with the synthetic gas which was also used in experiments 1 and 2 such that at ambient temperature the water/condensate/toluene/gas mixture was in equilibrium with the gas at a pressure of 4.0 MPa. Hereafter the cells were mounted on the rack and subsequently immersed in the ice/water mixture. The seesaw was activated such that the stainless steel balls rolled back and forth over the entire length of the cells once every eight seconds. Soon after the cells were immersed in the water/ice mixture the pressure in the cells dropped to 3.6 MPa because of the cooling of the mixture to 0° C. At a pressure of 3.6 MPa, stable hydrates can form in the cell at temperatures below 11° C. which means that the experiment was conducted at 11 degrees of subcooling. It was observed that in both cells a solid layer of hydrates, which also prevented the balls from moving, had formed within one hour after activation of the seesaw.

Experiment 4 (HYBRANES Preventing Hydrate Formation at 11° C. of Subcooling)

The ability of several functionalised HYBRANES to prevent hydrate formation at 11 degrees of subcooling was tested in duplicate by filling two cells with the same water/condensate/toluene/gas mixture as was used in experiment 3 described above, except for the addition of approximately 0.03 grams of a functionalised HYBRANE to the contents of both cells. Similar to experiment 3, the cells were immersed in an ice/water bath after which the seesaw was immediately activated.

It was observed that no hydrates formed within 20 hours after immersion of two cells in the ice bath and activation of the seesaw if the two cells contained 0.03 grams of either of the following functionalised HYBRANES:

HAm 1290: the structural units of which are hexahydrophthalic anhydride, di-isopropanol amine and morpholine with a Mn of 1200;

HAp 1390: the structural units in which are hexahydrophthalic anhydride, di-isopropanol amine and N-methyl piperazine with a Mn of 1300.

EXAMPLE V

Prevention of the Agglomeration of Hydrate Crystals in "Rolling Ball" Experiments Experiment 1 (Blank Experiment Conducted at 11.5° C. of Subcooling)

At ambient temperature (approximately 20° C.) two cells were filled with respectively 3 ml of an aqueous solution of sodium chloride (containing 3 w % of NaCl) and 9 ml of Maui condensate. Hereafter the cells were pressurised with a synthetic gas having the following composition: methane 86.2 mol %, ethane 2.8 mol %, propane 5.8 mol %, n-butane 0.8 mol %, iso-butane 0.6 mol %, nitrogen 1.7 mol % and carbon dioxide 2.1 mol %.

The water/condensate/toluene/gas mixture was carefully equilibrated such that at ambient temperature the pressure in the cells was 5.0 MPa. Hereafter the cells were mounted on the rack and subsequently immersed in the ice/water mixture. The seesaw was activated such that, during the next four hours, the stainless steel balls rolled back and forth over the entire length of the cells once every eight seconds. After 4 hours of rocking the cell pressures (approximately 4.2 MPa) were recorded and the contents of the cells were visually inspected. It appeared that in both cells a solid agglomerate of hydrates which adhered to the glass, the metal parts of the cell and the ball, had formed. The was frozen stuck by hydrates and could not be loosened even after violent shaking of the cells.

Experiment 2 (HYBRANES Preventing the Agglomeration of Hydrate Crystals at 11.5° C. of Subcooling)

The ability of several functionalised HYBRANES to prevent hydrate agglomeration at 11.5 degrees of subcooling was tested in duplicate by filling two cells with the same brine/condensate/toluene/gas mixture as was used in experiment 1 described above, except for the addition of 0.03 grams of a functionalised HYBRANE to the contents of both cells. As in experiment 1, the cells were immersed in an ice/water bath after which the seesaw was immediately activated. After 4 hours of rocking the cell pressures were recorded and the contents of the cells were visually inspected. It appeared that a homogeneous and non-viscous dispersion of fine hydrate crystals, which did not restrict the motion of the ball or adhered to glass and metal parts of the cells had formed after 4 hours of rocking if the cells contained 0.03 grams of either of the following functionalised HYBRANES:

D1400, D2000 and D2800: the structural units in which are 2-dodecenyl succinic anhydride and di-isopropanol amine with Mn of 1400, 2000 and 2800, respectively;

DV2110: the structural units in which are 2-dodecenyl succinic anhydride, di-isopropanol amine and coco fatty acid with a Mn of 2100;

DDC200010: the structural units in which are 2-dodecenyl succinic anhydride and di-isopropanol amine with a Mn of 2000;

D/H 10 2000: the structural units in which are 2-dodecenyl succinic anhydride, hexahydrophthalic anhydride and di-isopropanol amine with a Mn of 2000.

I claim:

1. A method for inhibiting the plugging of a conduit, the conduit containing a flowable mixture comprising at least an amount of hydrocarbons capable of forming hydrates in the presence of water, and an amount of water, which method comprises adding to the mixture an amount of a dendrimeric compound effective to inhibit the formation and/or accumulation of hydrates in the mixture at conduit temperatures and pressures; and flowing the mixture containing the dendrimeric compound and any hydrates through the conduit, wherein the dendrimeric compound comprises a three-dimensional, highly branched structure.

2. The method according to claim 1, in which a functionalized dendrimeric compound is used as hydrate formation inhibitor.

3. The method according to claim 1, in which a hyperbranched polyester amide is used as hydrate formation inhibitor.

4. The method according to claim 3, in which the hyperbranched polyester amide is used which is based on (self-) condensation reactions between a cyclic anhydride and a di- or trialkanolamine.

5. The method according to claim 4, in which a hyperbranched polyester amide is used having a number average molecular weight between about 500 to about 50,000.

6. The method according to claim 4, in which the cyclic anhydride is selected from the group consisting of succinic anhydride, glutaric anhydride, tetrahydrophthalic anhydride, hexahydrophthalic anhydride, phthalic anhydride, norbornene-2,3-dicarboxylic anhydride, naphthalenic dicarboxylic anhydride, optionally substituted by one or more alkyl or alkenyl substituents.

7. The method according to claim 4, in which the alkanolamine is diisopropanolamine.

8. The method according to claim 4, in which the polyester amide has been functionalized by morpholine.

9. The method according to claim 1, in which between about 0.05 to about 10% wt of dendrimeric compound, based on the amount of water in the hydrocarbon-containing mixture is added to the mixture.

10. The method according to claim 1, in which a non-dendrimeric corrosion or hydrate inhibitor and/or other oil-field chemicals such as corrosion and scale inhibitors are added to the mixture of hydrocarbons and water.

11. The method according to claim 4, in which the polyester amide has been functionalized by tertiary amine.

12. The method according to claim 4, in which the polyester amide has been functionalized by non-substituted piperazine end groups.

13. The method according to claim 4, in which the polyester amide has been functionalized by alkyl-substituted piperazine end groups.

* * * * *